US006015265A

United States Patent [19]

Lasko et al.

[11] Patent Number: 6,015,265

[45] Date of Patent: Jan. 18, 2000

[54] BOX FAN WITH AIR DIVIDER RING

[75] Inventors: William E. Lasko, West Chester, Pa.; Ralph Zwakenberg, Claymont, Del.; Rodney Wilson, Boothwyn, Pa.

[73] Assignee: Lasko Holdings, Inc., West Chester, Pa.

[21] Appl. No.: 09/143,607

[22] Filed: Aug. 31, 1998

[51] Int. Cl.[7] ..... B63H 1/28

[52] U.S. Cl. ..... 416/247 R; 415/121.2

[58] Field of Search ..... 415/121.2, 191; 416/247 R

[56] References Cited

U.S. PATENT DOCUMENTS 2,950,859 8/1960 Kirk ..... 415/247 R 3,867,058 2/1975 Hendrickson ..... 415/125

4,350,472 9/1982 Morimoto ..... 415/125

5,118,252 6/1992 Chaney ..... 415/119

*Primary Examiner*—Edward K. Look

*Assistant Examiner*—Ninh Nguyen

*Attorney, Agent, or Firm*—Zachary T. Wobensmith, III

[57] ABSTRACT

A box fan which includes an air divider ring as part of the front grill, which ring results in increases in the peak velocity of the air supplied by the fan, and the cubic foot per minute of the supplied air.

3 Claims, 7 Drawing Sheets

Construction

| | Date | Body | Motor | Blade | Grills | Notes |
|---|---|---|---|---|---|---|
| Test#1 | 4/30/99 | FULL BODY | 19 LAMINATION 110T-28-28-30 | 5P-BOXFAN 98 19 SECOND | ULTRA REAR-OPEN CORNER (FRT NO RING) | FRONT-ULTRA WITH OPEN CORNERS. NO VENTURI OR RING. |
| Test#2 | 4/30/98 | FULL BODY | 19 LAMINATION 110-28-28-30 | 5P-BOXFAN 98 19 SECOND | ULTRA REAR-OPEN CORNER (FRT RING) | FRONT-ULTRA WITH NO VENTURI. RING INSTALLED. |
| Test#3 | 4/30/98 | FULL BODY | 19 LAMINATION 110-28-28-30 | 5P-BOXFAN 98 19-SECOND | ULTRA REAR-OPEN CORNER FRT 19 RING | FRONT-ULTRA WITH NO VENTURI. 19" RING INSTALLED |
| Test#4 | 4/15/98 | FULL BODY | 19 LAM; 110 TURN 28-28-30 | BOXFAN-19 SEC. CYCLONE 5 PADDLE | FRONT OPEN-ULTRA REAR | 1.3" VENTURI-1.9" BLADE TO RING. |
| Test#5 | 4/15/98 | FULL BODY | 19 LAM, 110 TURN 28-28-30 | BOXFAN 98-19 SEC. CYCLONE 5 PADDLE | FRONT OPEN-ULTRA REAR | .700" VENTURI-2.5" BLADE TO RING. |
| Test#6 | | | | | | |

FIG. 6

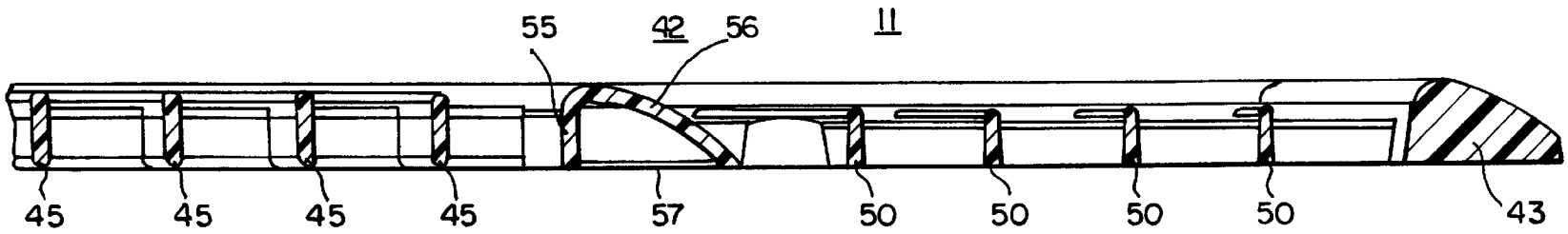

FIG. 5

Motor Performance

| | RPM | | | AMPS | | | WATTS | | | NOISE | | CFM | WEATHER | |
|---|---|---|---|---|---|---|---|---|---|---|---|---|---|---|
| | High | Medium | Low | High | Medium | Low | High | Medium | Low | High | Low | High | Temp. | Humid. |
| Test 1 | 972 | 731 | 535 | 1.65 | 1.19 | 0.923 | 154 | 111.0 | 83.3 | | | 3478 | | |
| Test 2 | 979 | 764 | 551 | 1.67 | 1.2 | 0.935 | 155 | 111.0 | 84.1 | | | 3569 | | |
| Test 3 | 978 | 751 | 554 | 1.66 | 1.19 | 0.928 | 154 | 111.0 | 83.7 | | | 3709 | | |
| Test 4 | 993 | 822 | 619 | 1.67 | 1.19 | 0.913 | 151.3 | 108.3 | 82.7 | | | 4003 | | |
| Test 5 | 982 | 795 | 600 | 1.650 | 1.170 | 0.910 | 152.200 | 108.2 | 82.4 | | | 3835 | | |
| Test 6 | | | | | | | | | | | | | | |

FIG. 8

BOX FAN WITH AIR DIVIDER RING

BACKGROUND OF THE INVENTION

1. Field of the Invention

This invention relates to a box fan of the type which has open front and rear grills with an air divider ring in the front grill to improve the efficiency of the fan.

2. Description of the Prior Art

Improving the air flow output of box fans without increasing the size or number of fan blades, or the horsepower of the driving motor is a goal of many fan designers.

It has been observed by smoke tests that fan grills with open corners tend to draw air into the front grill at the corners which air is then exhausted through the central area of the fan grill.

Various grill designs have been proposed to improve performance of the open grill fans with, for example, closed corners which reduces the grill area for air output, but this approach has not been found to increase the efficiency of the fans.

Inclusion of the air divider ring of the invention into the front grill increases both the fan efficiency, and the structural integrity of the front grill.

SUMMARY OF THE INVENTION

This invention relates to a box fan which has an open rear grill and an open front grill, which front grill has an air divider ring to divide air flow, and improve fan performance.

The principal object of the invention is to provide a box fan whose front grill has an air divider ring which increases the output efficiency of the fan.

A further object of the invention is to provide a box fan of the character aforesaid, whose front grill has increased strength.

A further object of the invention is to provide a box fan of the character aforesaid which is inexpensive to produce.

A further object of the invention is to provide a box fan of the character aforesaid which is sturdy and reliable in operation.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which:

FIG. 5 is a vertical sectional view, enlarged, taken approximately on the Line 5—5 of FIG. 1;

FIG. 6 is a table containing test results obtained with the divider ring of the invention;

FIG. 8 is a table illustrating driving motor performance for the test results shown in FIGS. 6 and 7.

Figure 1:
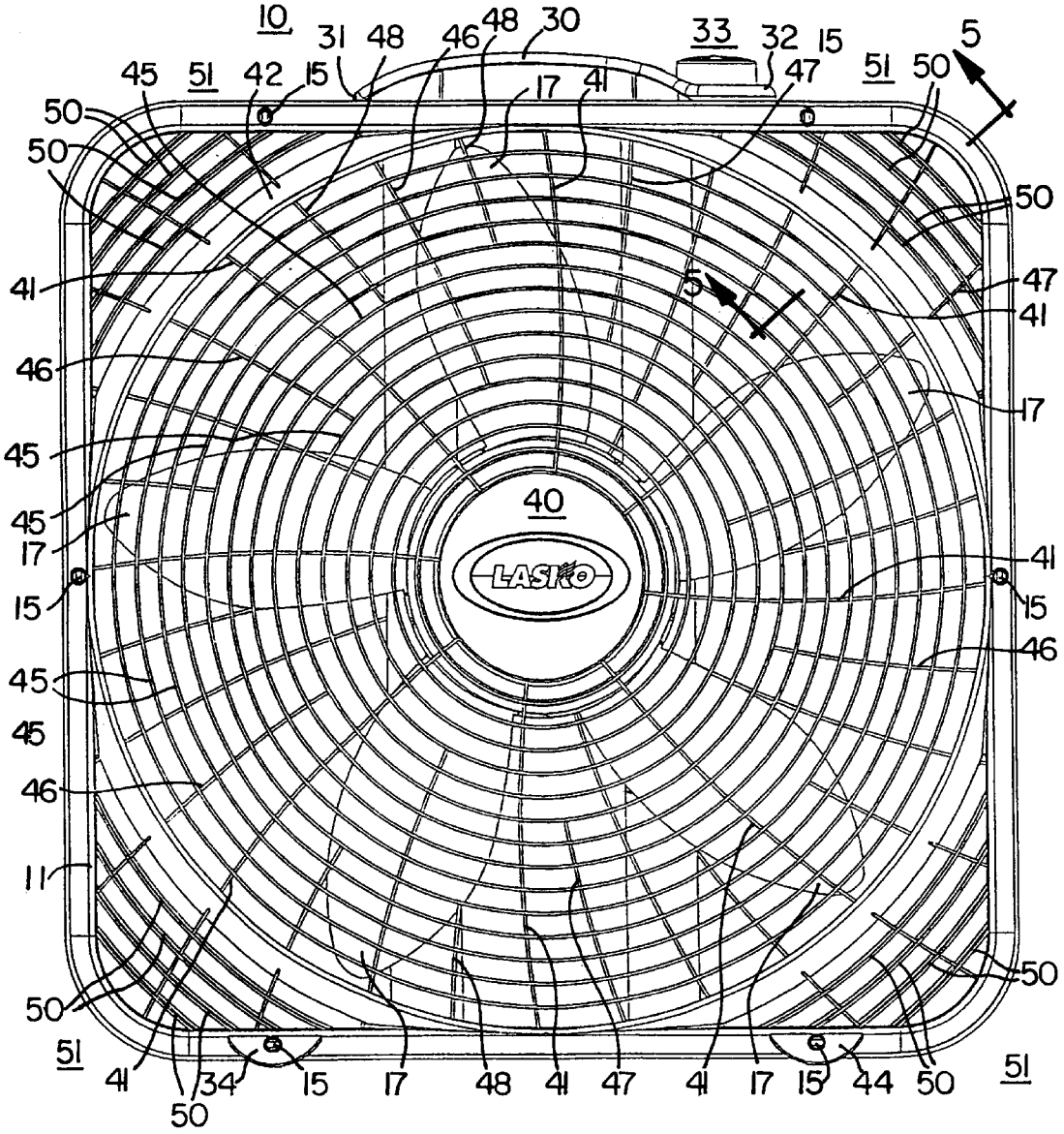
FIG. 1 is a front view of the box fan of the invention.
Figure 2:
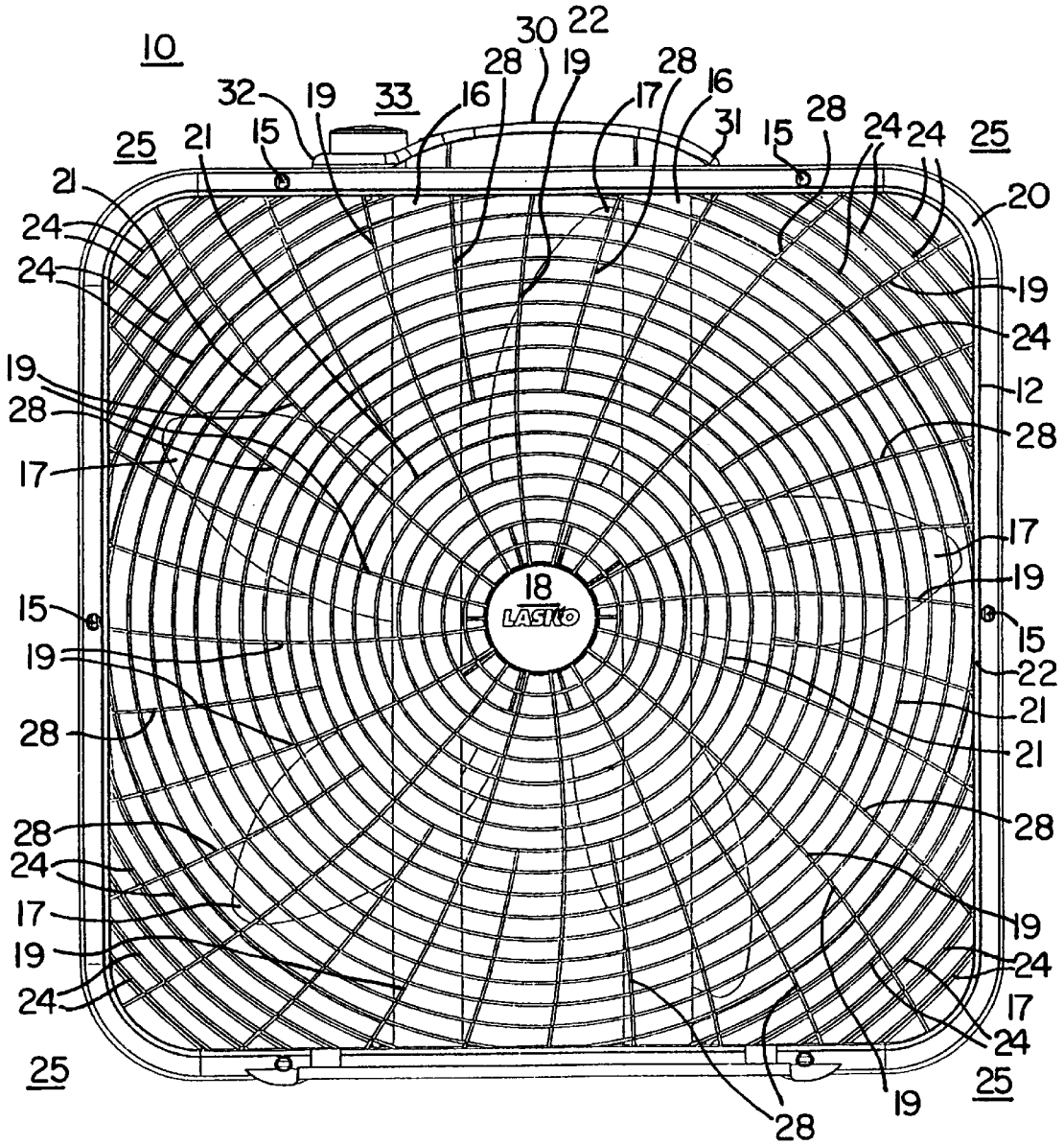
FIG. 2 is a rear view of the box fan of FIG. 1.
Figure 3:
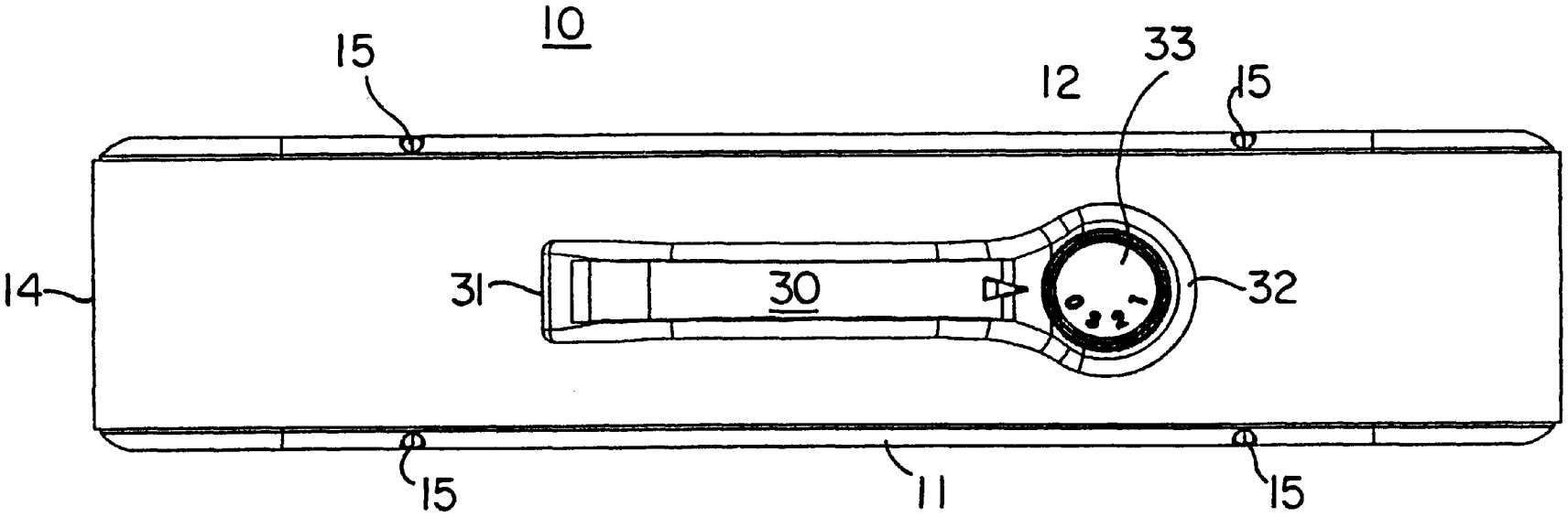
FIG. 3 is a top view of the box fan of FIG. 1.
Figure 4:
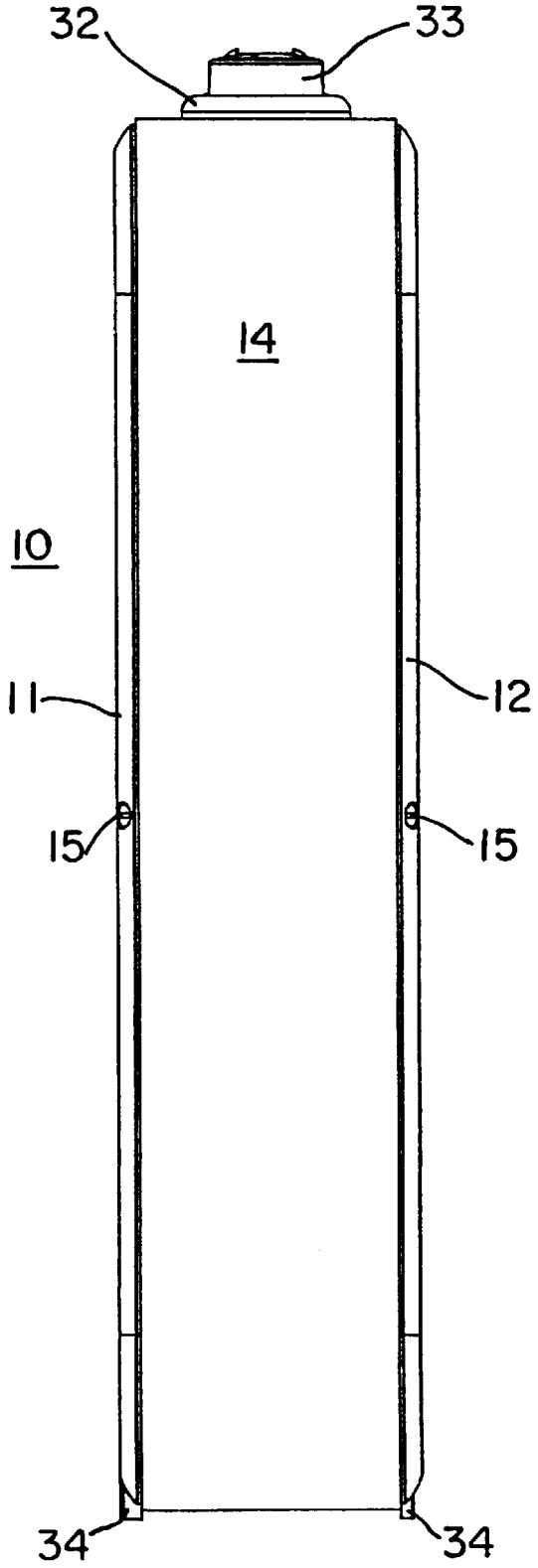
FIG. 4 is a right side view of the box fan of FIG. 1.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Referring now more particularly to FIGS. 1–5 of the drawings the box fan 10 of the invention is therein illustrated. The box fan 10, which is of square configuration, includes an open front grill 11, an open rear grill 12 and a housing 14 to which the front grill 11 and the rear grill 12 are detachably secured by fasteners 15.

The housing 14 is preferably formed of sheet metal, and the grilles 11 and 12 are of molded plastic, and preferably polypropylene.

The rear grill 12 has an electric motor (not shown) mounted to vertical brackets 16 in conventional manner which are connected to housing 14 (not shown). The motor has a rotatable hub (not shown) extending therefrom which carries a plurality of fan blades 17, five being illustrated.

The rear grill 12 has a round center plate 18 with a plurality of spaced radial ribs 19 connected thereto, and extending outwardly to a rim 20 of grill 12.

The ribs 19 are connected to a plurality of spaced concentric spiral ribs 21, which are spaced apart, and of progressively larger diameter as they approach rim 20, with the outermost rib 21 engaged with the rim 20 at four locations 22.

The ribs 19 are also connected to a plurality of spaced ribs 24 which extend across the outer corners 25 of grill 12, and are connected thereto at each end.

Additional radial ribs 28 are provided starting at the eighth spiral rib 21 from the center plate 18, some of which are also connected to ribs 21 and terminate at rim 20 to which they are connected.

The housing 14 at the top thereof has a carrying handle 30 which is connected thereto at ends 31 and 32 in well known manner. The handle 30 at end 32 has an on/off multispeed switch (not shown) with a knob 33, to control operation of the fan.

The grills 11 and 12 are also provided with projections 34 at the bottom thereof to provide additional stability.

The front grill 11 has a round center plate 40 with a plurality of radially extending ribs 41, which extend outwardly to an air divider ring 42, and therefrom to the rim 43 of grill 11. A plurality of spaced concentric circular ribs 45 are provided, which are attached to ribs 41, and are of increasingly larger diameter as they approach divider ring 42.

Radial ribs 46 are provided which extend from the third rib 45 from the plate 40, to the divider ring 42, and to rim 43. Radial ribs 47 are provided which extend from the fifth rib 45 from the plate 40 to divider ring 42, and to rim 43.

Additional radial ribs 48 are provided which extend from the ninth rib 45 from the plate 40 to the divider ring 42, and to rim 43.

Spaced ribs lengths 50 are provided, of circular configuration, which commence exteriorly of ring 42, and extend across the four corners 51 of grill 11, and to which ribs 46, 47 and 48 are connected as illustrated in FIG. 1.

The air divider ring 42 connects the four corners 51 of grill 11, and for a grill of 21 inches over all, preferably is of 19 inch diameter.

As shown more particularly in FIG. 5, the divider ring 42 for a 21 inch grill preferably has a width of 0.600 inches, a wall thickness of 0.065 inches, a height of 0.325 inches, a front wall 55, and a top wall 56, with a 1000 inclination of the front wall 55 to the base wall 57.

The ribs 45 preferably have a width of 0.070 inches, and the rib lengths 50 have a width of 0.070 inches.

Figure 7:
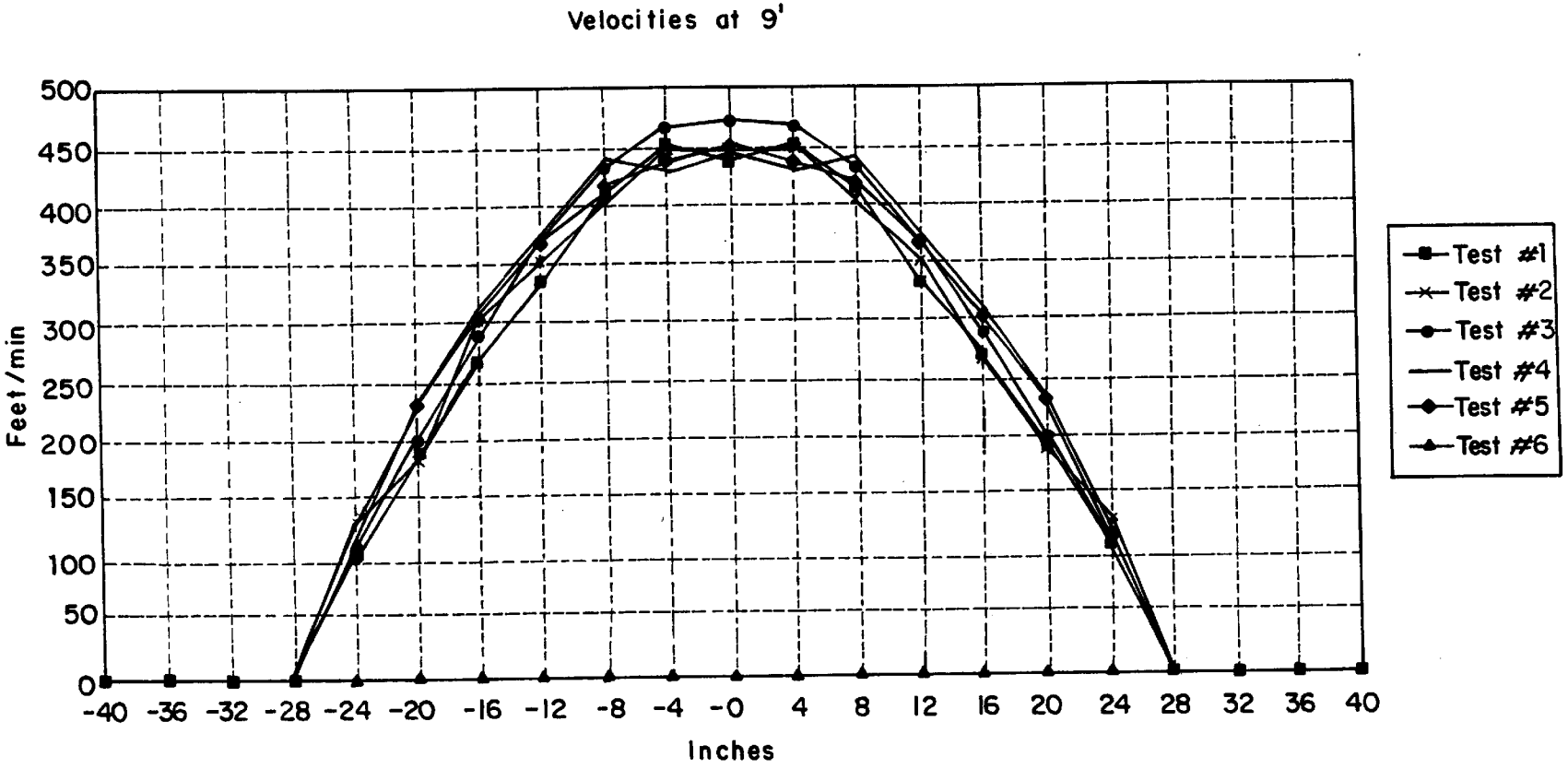
FIG. 7 is a graph illustrating test results obtained with the divider ring of the invention.

As shown in FIGS. 6, 7 and 8 tests were conducted to determine the effect of adding an air divider ring to the front grill 11, with various grill configurations, with the results plotted in the graph of FIG. 7. The test results for the cubic feet/minute output obtained for the various grill arrangements disclosed that the addition of the air divider ring 42 increased the CFM by 3%, and the peak velocity by 5%.

It will thus be apparent that the objects of the invention have been achieved.

We claim:

1. A box fan which includes an open housing of square configuration, a fan motor mounted to said housing, a rotatable hub mounted to and driven by said motor, a plurality of fan blades on said hub, an open rear grill mounted to said housing and an open front grill mounted to said housing, the improvement which comprises said front grill has a center plate, a plurality of concentric circular ribs spaced outwardly from said center plate of increasing diameter, a rim extending around the perimeter of said front grill, a plurality of spaced radial ribs connecting selected concentric circular ribs and extending to said rim, a plurality of spaced concentric circular rib lengths connecting the corners of said front grill, an air divider ring spaced inwardly of said rib lengths connecting the corners of said front grill with selected radial ribs, connected thereto and to said rim, and said air divider ring having a substantially greater width than said concentric circular ribs.

2. A box fan as defined in claim 1 in which said housing is of sheet metal and said front and rear grills are of molded plastic.

3. A box fan as defined in claim 1 in which the width of said air divider ring is nine times the width of said concentric circular ribs and rib lengths.

* * * * *

UNITED STATES PATENT AND TRADEMARK OFFICE

CERTIFICATE OF CORRECTION

PATENT NO. : 6,015,265

DATED : Jan. 18, 2000

INVENTOR(S) : William E. Lasko et. al.

It is certified that error appears in the above-indentified patent and that said Letters Patent is hereby corrected as shown below:

Column 3, line 7 after "with a" 1000 should be -100 degree-

Signed and Sealed this

Fifth Day of December, 2000

*Attest:*

Q. TODD DICKINSON

*Attesting Officer*

*Director of Patents and Trademarks*